US007082951B2

(12) United States Patent
Barnabas et al.

(10) Patent No.: US 7,082,951 B2
(45) **Date of Patent: *Aug. 1, 2006**

(54) AQUEOUS COMPOSITIONS FOR TREATING A SURFACE

(75) Inventors: Mary Vijayarani Barnabas, West Chester, OH (US); Nicola John Policicchio, Cincinnati, OH (US); Alan Edward Sherry, Cincinnati, OH (US); Ann Margaret Wolff, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/957,558

(22) Filed: Oct. 1, 2004

(65) Prior Publication Data

US 2005/0043203 A1 Feb. 24, 2005

Related U.S. Application Data

(63) Continuation of application No. 10/267,266, filed on Oct. 9, 2002, now Pat. No. 6,814,088, application No. 10/957,558, which is a continuation-in-part of application No. 10/737,129, filed on Dec. 15, 2003, now Pat. No. 6,936,580, which is a continuation of application No. 09/671,718, filed on Sep. 27, 2000, now Pat. No. 6,716,805.

(60) Provisional application No. 60/328,006, filed on Oct. 9, 2001, provisional application No. 60/156,286, filed on Sep. 27, 1999.

(51) Int. Cl.

| | |
|---|---|
| ***B08B 1/00*** | (2006.01) |
| ***B08B 3/04*** | (2006.01) |
| ***C11D 1/66*** | (2006.01) |
| ***C11D 1/88*** | (2006.01) |
| ***C11D 3/48*** | (2006.01) |

(52) U.S. Cl. ..... 134/25.2; 134/25.3; 134/39; 134/40; 134/42; 510/238; 510/239; 510/240; 510/264; 510/413; 510/421; 510/470; 510/475; 510/499; 510/295

(58) Field of Classification Search ..... 510/238, 510/239, 240, 264, 413, 421, 470, 475, 499, 510/295; 134/25.2, 25.3, 39, 40, 42
See application file for complete search history.

(56) References Cited

U.S. PATENT DOCUMENTS

| | | | |
|---|---|---|---|
| 3,489,686 | A | 1/1970 | Parran, Jr. |
| 3,718,597 | A | 2/1973 | Werdehausen et al. |
| 4,444,790 | A | 4/1984 | Green et al. |
| 4,450,174 | A | 5/1984 | Green et al. |
| 4,456,543 | A | 6/1984 | Owens |
| 4,540,505 | A | 9/1985 | Frazier |
| 4,597,887 | A | 7/1986 | Colodney et al. |
| 4,597,898 | A | 7/1986 | VanderMeer |
| 4,748,158 | A | 5/1988 | Biermann et al. |
| 4,793,942 | A | 12/1988 | Lokkesmoe et al. |
| 4,868,217 | A | 9/1989 | Araki et al. |
| 4,885,102 | A | 12/1989 | Yamamura et al. |
| 4,919,837 | A | 4/1990 | Gluck |
| 4,923,685 | A | 5/1990 | Wuelknitz et al. |
| 4,937,008 | A | 6/1990 | Yamamura et al. |
| 4,946,672 | A | 8/1990 | Gibbs |
| 5,000,867 | A | 3/1991 | Heinhuis-Walther et al. |
| 5,141,803 | A | 8/1992 | Pregozen |
| 5,164,107 | A | 11/1992 | Khan et al. |
| 5,444,094 | A | 8/1995 | Malik et al. |
| 5,454,984 | A | 10/1995 | Graubart et al. |
| 5,522,942 | A | 6/1996 | Graubart et al. |
| 5,529,713 | A | 6/1996 | Gauthier-Fournier |
| 5,565,145 | A | 10/1996 | Watson et al. |
| 5,719,113 | A | 2/1998 | Fendler et al. |
| 5,798,329 | A | 8/1998 | Taylor et al. |
| 5,849,682 | A | 12/1998 | Van Eenam |
| 5,854,187 | A | 12/1998 | Blum et al. |
| 5,904,735 | A | 5/1999 | Gutierrez et al. |
| 5,908,854 | A | 6/1999 | McCue et al. |
| 5,911,915 | A | 6/1999 | Fonsny et al. |
| 5,922,693 | A | 7/1999 | Oldenhove |
| 5,929,016 | A | 7/1999 | Harrison |
| 5,962,391 | A | 10/1999 | Oldenhove |
| 6,017,869 | A | 1/2000 | Lu et al. |
| 6,022,841 | A | 2/2000 | Lu et al. |
| 6,045,817 | A | 4/2000 | Ananthapadmanabhan et al. |
| 6,057,278 | A | 5/2000 | Gosselink et al. |
| 6,075,000 | A | 6/2000 | Rohrbaugh et al. |
| 6,080,706 | A | 6/2000 | Blanvalet et al. |
| 6,083,517 | A | 7/2000 | Ananthapadmanabhan et al. |
| 6,096,701 | A | 8/2000 | Mondin et al. |
| 6,110,295 | A | 8/2000 | Lu et al. |
| 6,121,224 | A | 9/2000 | Fonsny et al. |
| 6,127,331 | A | 10/2000 | Cleary et al. |
| 6,130,196 | A | 10/2000 | Mondin et al. |
| 6,140,289 | A | 10/2000 | McCandlish et al. |
| 6,143,710 | A | 11/2000 | Lu et al. |
| 6,156,720 | A | 12/2000 | Boeckh et al. |
| 6,159,924 | A | 12/2000 | Weller et al. |

(Continued)

FOREIGN PATENT DOCUMENTS

| | | |
|---|---|---|
| EP | 185970 | * 12/1985 |

(Continued)

*Primary Examiner*—Brian P Mruk
(74) *Attorney, Agent, or Firm*—Mark A. Charles; Thibault Fayette; Kim W. Zerby

(57) ABSTRACT

The present invention relates to a composition having a pH of less than about 7, for treating a hard surface comprising: at least one low residue surfactant and/or an alkyl ethoxylate surfactant; and a polymeric biguanide.

39 Claims, No Drawings

U.S. PATENT DOCUMENTS

| | | | | |
|---|---|---|---|---|
| 6,187,737 | B1 | 2/2001 | Geke et al. | |
| 6,191,092 | B1 | 2/2001 | Bragulla et al. | |
| 6,284,723 | B1 | 9/2001 | Zhou et al. | |
| 6,300,304 | B1 | 10/2001 | Boeckh et al. | |
| 6,303,557 | B1 | 10/2001 | Colclough | |
| 6,323,171 | B1 | 11/2001 | Fonsny et al. | |
| 6,358,909 | B1 | 3/2002 | Ochomogo et al. | |
| 6,384,004 | B1 | 5/2002 | McCandlish et al. | |
| 6,387,865 | B1 | 5/2002 | Mondin et al. | |
| 6,387,866 | B1 | 5/2002 | Mondin et al. | |
| 6,458,753 | B1 | 10/2002 | Haylett | |
| 6,465,412 | B1 | 10/2002 | Mahieu et al. | |
| 6,475,976 | B1 | 11/2002 | Mahieu et al. | |
| 6,528,472 | B1 | 3/2003 | Charaf et al. | |
| 6,559,116 | B1 | 5/2003 | Binski et al. | |
| 6,596,681 | B1 | 7/2003 | Mahieu et al. | |
| 6,716,805 | B1 | 4/2004 | Sherry et al. | |
| 6,814,088 | B1 * | 11/2004 | Barnabas et al. | 134/25.2 |
| 6,936,580 | B1 * | 8/2005 | Sherry et al. | 510/438 |
| 2001/0044393 | A1 | 11/2001 | Peterson, Jr. et al. | |
| 2001/0049347 | A1 | 12/2001 | Robbins et al. | |
| 2002/0022660 | A1 | 2/2002 | Jampani et al. | |
| 2002/0041862 | A1 | 4/2002 | Prusiner et al. | |
| 2002/0173437 | A1 | 11/2002 | Rabon et al. | |
| 2002/0183233 | A1 | 12/2002 | Mitra et al. | |
| 2003/0100465 | A1 | 5/2003 | Kilkenny et al. | |
| 2003/0109411 | A1 | 6/2003 | Kilkenny et al. | |
| 2003/0119705 | A1 | 6/2003 | Barnabas et al. | |
| 2003/0148913 | A1 | 8/2003 | Klinkhammer et al. | |
| 2003/0148917 | A1 | 8/2003 | Mitra et al. | |
| 2003/0157856 | A1 | 8/2003 | Schroeder et al. | |
| 2003/0186830 | A1 | 10/2003 | Godfroid et al. | |
| 2003/0216273 | A1 | 11/2003 | Mitra et al. | |

FOREIGN PATENT DOCUMENTS

| | | | |
|---|---|---|---|
| EP | 0 185 970 | | 7/1986 |
| EP | 0 252 695 | A2 | 1/1988 |
| EP | 0 827 691 | A1 | 3/1998 |
| EP | 1 146 112 | A1 | 10/2001 |
| FR | 2 710 919 | | 4/1995 |
| WO | WO98/25650 | A2 | 6/1998 |
| WO | WO 02/070639 | A1 | 9/2002 |
| WO | WO03/018732 | A1 | 3/2003 |

* cited by examiner

AQUEOUS COMPOSITIONS FOR TREATING A SURFACE

CROSS REFERENCE TO RELATED APPLICATION

This application is a Continuation of U.S. patent application Ser. No. 10/267,266 to Barnabas et al. filed Oct. 9, 2002 now U.S. Pat. No. 6,814,088, which claims the benefit of U.S. Provisional Application No. 60/328,006, filed on Oct. 9, 2001. This application is also a Continuation-In-Part of U.S. patent application Ser. No. 10/737,129 to Sherry et al. filed Dec. 15, 2003 now U.S. Pat. No. 6,936,580, which is a Continuation of U.S. patent application Ser. No. 09/671,718 to Sherry et al. filed Sep. 27, 2000 now U.S. Pat. No. 6,716,805, which claims the benefit of U.S. Provisional Application No. 60/156,286, filed on Sep. 27, 1999.

FIELD OF THE INVENTION

The present invention relates to antimicrobial compositions for treating a surface, in particular to aqueous liquid compositions. The compositions comprise a polymeric biguanide. Aqueous compositions according to the present invention were found to exhibit a superior filming/streaking and shine retention/enhancement profile, as measured using a standard gloss-meter, whilst providing excellent disinfecting and/or antimicrobial benefits.

BACKGROUND OF THE INVENTION

Liquid compositions for treating hard surfaces, such as, kitchen and bathroom surfaces, eyeglasses, and surfaces that require cleaning in industry for example surfaces of machinery or automobiles are known in the art. Such compositions can be used as such in a neat cleaning operation or in diluted form. Such compositions are often used in combination with conventional wiping products or more recently in combination with absorbent disposable cleaning pads.

Conventional wiping products are typically natural or synthetic sponges, soft or scouring pads, brushes, cloths, paper towels. Such wiping products can be used, as desired, in combination with cleaning implements comprising a handle for tough to reach areas or for the cleaning of floors, walls, or other large area surfaces either inside or outside the home, in office settings or in commercial or public establishments. Such devices can also have the wiping element combined or built into the handle such as sponge mops, string mops and strip mops. Pre-moistened wipe cleaning products in the form of laminates are commercially available. One example is Swiffer Wet®, a tri-laminate wipe that comprises an aqueous composition impregnated on a point-bonded floor sheet, a cellulosic reservoir core and a spun-bond attachment sheet. Such products are further detailed in WO 2000-2000US26401, incorporated herein by reference.

Absorbent disposable cleaning pads represent a new method of cleaning, geared toward achieving outstanding end result. These disposable pads are advantageous in that they not only loosen dirt, but also absorb more of the dirty solution as compared to conventional cleaning tools or pre-moistened wipes. As a result, surfaces are left with reduced residue and dry faster. The use of disposable pads comprising super-absorbent polymer, i.e., absorbent disposable cleaning pads are particularly advantageous in that the polymer improves the mileage, longevity, reuse-ability and economic value of the pads. Such pads are disclosed in U.S. Pat. Nos. 6,048,123; 6,003,191; 5,960,508; and 6,101,661; incorporated herein by reference. The pads can be used as stand-alone products or in combination with an implement comprising a handle, particularly for the cleaning of floor surfaces. An example of such a product is currently sold by Procter and Gamble under "Swiffer WETJET®".

A commonly known problem in treating hard surfaces is the formation of films and/or streaks on surfaces treated therewith. Indeed, after the treatment of a hard surface with a liquid composition, the formation of visible residues (streaks) and/or shine reducing films after drying can often be observed.

Furthermore, the addition of an antimicrobial agent, to compositions intended to wipe and clean surfaces, increases the tendency of filming/streaking on said hard. The filming/streaking is particularly problematic when treating glossy surfaces, such as porcelain, chrome and other shiny metallic surfaces, tiles etc.

It is therefore an object of this invention to provide a composition that shows a filming/streaking performance benefit (low or substantially no formation of streak- and/or film-formation).

It has now been found that the above objective can be met by a composition for treating a hard surface having a pH of about 7 or less and comprising at least one low-residue surfactant and/or an alkyl ethoxylate surfactant; and a polymeric biguanide.

It is an advantage of this invention to provide aqueous compositions, either in dilutable or in neat form that can be used in conjunction with sponges, cloths, rags, paper towels and the like. Such products can function as stand-alone products or can be used in combination with conventional cleaning implements including sponge mops, string mops, strip mops or used with an absorbent disposable cleaning pad that is optionally attached to a cleaning implement comprising a handle and mop head.

It is another an advantage that judicious selection of surfactant and composition pH, can result in an enhancement of the gloss on the tiles, either versus clean untreated tiles, or tiles treated with a base composition that lacks the polymeric biguanide.

It is another advantage of this invention to provide disinfecting or antimicrobial compositions that leave little or no visible residue on hard surfaces. Furthermore, such compositions can be used in conjunction with cleaning tools with or without cleaning implements (defined herein after), including sponges, cellulose strings or strips, clean paper or commercially available paper towels, or absorbent disposable cleaning pads or substrate.

Advantageously, the compositions herein may be used to treat shiny and matt hard-surfaces made of a variety of materials like glazed and non-glazed ceramic tiles, vinyl, no-wax vinyl, linoleum, melamine, glass, plastics, plastified wood.

A further advantage of the present invention is that an excellent cleaning performance is obtained on different types of stains and soils.

BACKGROUND ART

Aqueous compositions comprising polymeric biguanides are known in the art. For example, WO 98/56253 discloses a composition comprising a carrier and a polymeric biguanide compound in the form of its salt with an organic acid containing from 4 to 30 carbon atoms such as poly (hexamethylene biguanide) stearate. These compositions comprising poly (hexamethylene biguanide) exhibit high antimicrobial, especially antibacterial activity, and exhibit increased solubility in organic media, especially organic liquids. U.S. Pat. No. 5,141,803 discloses compositions for use in hard surfaces comprising biguanide antimicrobial compounds. EP 0 185 970 describes liquid disinfectant preparations for use on hard surfaces comprising specific oligo-hexamethyl biguanides, specific microbiocidically active phenolic compounds and, optionally builders. U.S. Pat. No. 6,045,817 discloses an antibacterial cleaning composition (pH ≧7.5) comprising (1) 0.05%–1% of a cationic polymer having a charge density of 0.0015 or higher, (2) 0.2–5% of a zwitterionic surfactant, and (3) 0.2–5% of a biguanide compound.

Much effort has recently been devoted to the search and identification of a low residue composition that provides antimicrobial effectiveness. For example, U.S. Pat. Nos. 6,159,924, 6,090,771, and 5,929,016 disclose low residue aqueous hard surface cleaning compositions comprising quaternary amine compounds, an organic solvent system and selected surfactant combinations. However, none of the compositions in the art are found to be completely satisfactory.

SUMMARY OF THE INVENTION

The present invention relates to aqueous liquid composition (i) having a pH of about 7 or less and comprising (ii) at least about one low-residue surfactant and/or an alkyl ethoxylate surfactant; and (iii) a polymeric biguanide.

The compositions simultaneously deliver excellent cleaning properties against acid- and alkaline-sensitive soils, excellent filming/streaking properties on a variety of hard surfaces and high biocidal effectiveness against relevant Gram positive and Gram negative organisms found in consumer homes, public domains, or commercial establishments.

Accordingly, the compositions of the present invention are preferably used for wiping and cleaning various surfaces, preferably hard surfaces.

DETAILED DESCRIPTION OF THE INVENTION

Definitions

By 'cleaning tool' it is meant any material used to clean surfaces. A cleaning tool, as defined herein, must directly contact the surface to be cleaned. Cleaning tool materials include conventional cleaning aids such as sponges, cloths, cellulose strings or strips, paper or commercially available paper towel, as well as novel cleaning tools including floor wipe laminates and absorbent disposable cleaning pads.

By 'implement' or 'cleaning implement', it is meant any material used in conjunction with cleaning tools to make the cleaning job easier, more efficient or more convenient. Cleaning implements consist of mop heads or short or long pole attachments with or without the mop heads, or other means used to attach, in any manner possible, a cleaning tool.

By 'absorbent' it is meant any material or laminate that can absorb at least about 1 gram of de-ionized per gram of said material.

By 'absorbent disposable cleaning pad' it is meant an absorbent pad that is typically used for a cleaning job and then disposed of. Absorbent disposable cleaning pads can range from simple dry absorbent non-woven structures to multi-layered absorbent composites. While it is understood that some pad designs can be used, stored and re-used, the amount of re-use is limited and is typically determined by the ability of the pad to continue to absorb more liquid and/or dirt. Unlike conventional systems such as sponge mops, strip and string mops, which are considered fully re-usable, once saturated, an absorbent disposable pad is not designed to be reversed by the consumer to get it back to its original state.

Aqueous Composition

The composition of the present invention is formulated as a liquid composition. A preferred composition herein is an aqueous composition and therefore, preferably comprises water more preferably in an amount of from about 50% to about 99%, even more preferably of from about 60% to about 98% and most preferably about 70% to about 97% by weight of the total composition.

The aqueous compositions of the present invention comprise a pH of about 7 or less and at least about one surfactant so as to lower the contact angle between the compositions and relevant hard surfaces, thereby assisting the wetting of such surfaces. The compositions also include a polymeric biguanide compound, which in the presence of the surfactant, acts as a hydrophilic wetting agent and preferably as an antimicrobial compound. In a preferred embodiment, the surfactant is a low residue surfactant, as further described herein. In another highly preferred embodiment, the aqueous compositions also comprise at least one water-soluble solvent with a vapour pressure of greater than about 0.05 mm Hg at 1 atmosphere pressure (about 6.66 Pa).

The solids content of the aqueous compositions of the present invention, at usage levels is generally low, preferably from about 0% to about 4%, more preferably from about 0.05% to about 3%, most preferably from about 0.10% to about 2.0%. Those skilled in the art will recognize that the aqueous compositions of the present invention can be made in the form of about 5×, about 10×, or even higher concentrates as desired, and then diluted prior use. This is expected particularly when the aqueous composition is sold as a liquid intended to be diluted in a bucket or other receptacle. The making of concentrated solutions can also be beneficial if the aqueous composition must be transported.

Composition pH

The aqueous compositions have a pH of about 7 or less. It is found that the filming and streaking benefits are not observed, or are substantially attenuated, at a pH higher than about 7. The pH range of the compositions is preferably from about 0.5 to about 7, more preferably from pH about 1.0 to about 6, more preferably from pH about 2 to about 5.5, and most preferably from pH about 2.5 to about 5.

In one preferred embodiment, the aqueous composition has a pH of from about 5 to about 7 and does not include an acidifying agent. In this embodiment the benefits of the invention are most noteworthy when the aqueous composition comprises at least about one surfactant selected from the group consisting of C8–16 poly alkyl glycosides.

Acidifying Agent

In the preferred embodiment wherein the aqueous composition herein comprises at least one acidifying agent, the pH range of the compositions is preferably from about 0.5 to about 7, more preferably from pH about 1.0 to about 6, more preferably from pH about 2 to about 5.5, and most preferably from pH about 2.5 to about 5. A suitable acid for use herein is an organic and/or an inorganic acid, most preferably an organic acid. Suitable organic acids are monomeric, oligomeric or polymeric organic acids.

Examples of a suitable organic acids include acetic acid, glycolic acid, lactic acid, succinic acid, adipic acid, malic acid, tartaric acid, lactic acid, polyacrylic acid, poly-aspartic acid, and the like. Highly preferred organic acids are selected from the group consisting of succinic acid, glutaric acid, adipic acid, lactic acid, tartaric acid and citric acid. For cost, availability, buffering capacity and regulatory reasons, citric acid (food grade desired but not required) is most preferred.

A typical level of organic acid for product is from about 0.01% to about 30%, preferably from about 0.05% to about 10% and more preferably from about 0.1% to about 7.5% by weight of the total composition. At the actual product use levels, following recommended product dilution, if any, a typical level of organic acid is of from about 0.01% to about 3%, preferably from about 0.05% to about 2% and more preferably from about 0.1% to about 0.75% by weight of the total composition. The specific level of acid will depend on the magnitude and type of the benefits sought. Higher levels promote improved cleaning of acid-sensitive soils while lower levels provide better filming streaking. The most preferred levels have been found to provide a combination of adequate buffering capacity, excellent cleaning and good filming/streaking properties. As such, organic acids selected from the group consisting of citric acid, tartaric acid and lactic acid are highly preferred.

In a preferred embodiment, the compositions are applied on hard surfaces soiled with hard watermarks, limescale and/or soap scum, and the like. Such soils are frequently encountered on bathroom surfaces. Accordingly, the compositions herein may further comprise acid or base buffers to adjust pH as appropriate.

Low-Residue Surfactant:

In a particularly preferred embodiment, the composition according to the present invention comprises a low-residue surfactant or a mixture thereof.

By "low-residue surfactant" it is meant herein any surfactant that mitigates the appearance of either streaks or films upon evaporation of the aqueous compositions comprising said surfactant. A low residue surfactant-containing composition may be identified using either gloss-meter readings or expert visual grade readings. The conditions for the determination of what constitutes a low-residue surfactant are one of the following: (a) less than about 1.5% gloss loss on black shiny porcelain tiles, preferably on black shiny Extracompa® porcelain tiles used in this invention; or (b) lack of significant filming and/streaking as judged by one skilled in the art. One of the important advantages of the low residue surfactant is that it requires less polymeric biguanide compound for gloss enhancement, relative to non-low residue surfactants. This can be important in light of cost considerations, potential stickiness issues delivered by higher concentrations of the polymeric biguanide, and/or concerns over the ability to completely strip a more concentrated polymeric biguanide film.

Whilst not wishing to be limited by theory, it is believed that low-residue surfactants exhibit a reduced tendency for inter-molecular aggregation. With less aggregation of surfactant molecules to form visible macromolecular complexes following evaporation of water from the aqueous compositions, the remaining residue is less visible, resulting in fewer streaks. Unlike conventional non-ionic surfactants such as alkyl ethoxylates and alkyl phenol ethoxylates, which exhibit rich phase chemistry, the "low residue" surfactants do not easily form anisotropic macromolecular structures in water, which helps make the film which they form upon dry-down from solution less visible. Indeed, the residue is observed to be nearly colorless, leading to films that are essentially not visible to the naked eye or in some instances, films that enhance the gloss of the treated tiles.

As identified within this invention there are three classes of low-residue surfactants: selected non-ionic surfactants, and zwitterionic surfactants and amphoteric surfactants and mixtures thereof. One class of low residue surfactants is the group of non-ionic surfactants that include a head group consisting of one or more sugar moieties. Examples include alkyl polyglycosides, especially poly alkyl glucosides, and sucrose esters. The chain length of these non-ionic surfactants is preferably about C6 to about C18, more preferably from about C8 to about C16. The hydrophilic component of these surfactants may comprise one or more sugar moieties liked by glycosidic linkages. In a preferred embodiment, the average number of sugar moieties per surfactant chain length is from about 1 to about 3, more preferably from about 1.1 to about 2.2.

The most preferred non-ionic low residue surfactants are the alkylpolysaccharides that are disclosed in U.S. patents: U.S. Pat. No. 5,776,872, Cleansing compositions, issued Jul. 7, 1998, to Giret, Michel Joseph; Langlois, Anne; and Duke, Roland Philip; U.S. Pat. No. 5,883,059, Three in one ultra mild lathering antibacterial liquid personal cleansing composition, issued Mar. 16, 1999, to Furman, Christopher Allen; Giret, Michel Joseph; and Dunbar, James Charles; etc.; U.S. Pat. No. 5,883,062, Manual dishwashing compositions, issued Mar. 16, 1999, to Addison, Michael Crombie; Foley, Peter Robert; and Allsebrook, Andrew Micheal; and U.S. Pat. No. 5,906,973, issued May 25, 1999, Process for cleaning vertical or inclined hard surfaces, by Ouzounis, Dimitrios and Nierhaus, Wolfgang.

Suitable alkyl polyglucosides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing about 5 or about 6 carbon atoms can be used, e.g., glucose, galactose, and galactosyl moieties can be substituted for the glucosyl moieties. (Optionally the hydrophobic group is attached at the 2-, 3-, 4-, etc. positions thus giving a glucose or galactose as opposed to a glucoside or galactoside.). The intersaccharide bonds can be, e.g., between the one position of the additional saccharide units and the 2-, 3-, 4-, and/or 6-positions of the preceding saccharide units. The glycosyl is preferably derived from glucose.

Optionally, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group can contain up to about 3 hydroxy groups and/or the polyalkyleneoxide chain can contain up to about 10, preferably less than about 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula:

$$R^2O(C_nH_{2n}O)_t(\text{glucosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is about 2 or about 3, preferably about 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Zwitterionic surfactants represent a second class of highly preferred low residue surfactants. Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082, incorporated herein by reference.

A generic formula for some preferred zwitterionic surfactants is:

$$R—N^+(R^2)(R^3)(R^4)X^-,$$

wherein R is a hydrophobic group; $R^2$ and $R^3$ are each a C1–4 alkyl hydroxy alkyl or other substituted alkyl group which can be joined to form ring structures with the N; $R^4$ is a moiety joining the cationic nitrogen to the hydrophilic anionic group, and is typically an alkylene, hydroxy alkylene, or polyalkoxyalkylene containing from one to four carbon atoms; and X is the hydrophilic group, most preferably a sulfonate group.

Preferred hydrophobic groups R are alkyl groups containing from about 6 to about 20 carbon atoms, preferably less than about 18 carbon atoms. The hydrophobic moieties can optionally contain sites of instauration and/or substituents and/or linking groups such as aryl groups, amido groups, ester groups, etc. In general, the simple alkyl groups are preferred for cost and stability reasons. A specific example of a "simple" zwitterionic surfactant is 3-(N-dodecyl-N,N-dimethyl)-2-hydroxypropane-1-sulfonate available from the Degussa-Goldschmidt Company under the tradename Varion HC®.

Other specific zwitterionic surfactants have the generic formula:

$$R—C(O)—N(R^2)—(CR^3{}_2)_n—N(R^2)_2{}^+—(CR^3{}_2)_n—SO_3{}^-,$$

wherein each R is a hydrocarbon, e.g., an alkyl group containing from about 6 to about 20, preferably up to about 18, more preferably up to about 16 carbon atoms, each ($R^2$) is either a hydrogen (when attached to the amido nitrogen), short chain alkyl or substituted alkyl containing from about 1 to about 4 carbon atoms, preferably groups selected from the group consisting of methyl, ethyl, propyl, hydroxy substituted ethyl and propyl and mixtures thereof, more preferably methyl, each ($R^3$) is selected from the group consisting of hydrogen and hydroxyl groups, and each n is a number from about 1 to about 4, more preferably about 2 or about 3, most preferably about 3, with no more than about 1 hydroxy group in any ($CR^3{}_2$) moiety. The R group can be linear or branched, saturated or unsaturated. The $R^2$ groups can also be connected to form ring structures. A highly preferred low residue surfactant of this type is a C12–14 acylamidopropylene (hydroxypropylene)_sulfobetaine that is available from Degussa-Goldschmidt under the tradename Rewoteric AM CAS-15U®.

Compositions of this invention containing the above hydrocarbyl amido sulfobetaine can contain more perfume and/or hydrophobic perfumes than similar compositions containing conventional anionic surfactants. This can be desirable in the preparation of consumer products.

Other very useful zwitterionic surfactants include hydrocarbyl, e.g., fatty alkylene betaines. These surfactants tend to become more cationic as pH is lowered due to protonation of the carboxyl anionic group, and in one embodiment have the generic formula:

$$R—N(R^1)_2{}^+—(CR^2{}_2)_n—COO^-,$$

wherein R is a hydrocarbon, e.g., an alkyl group containing from about 6 to about 20, preferably up to about 18, more preferably up to about 16 carbon atoms, each ($R^1$) is a short chain alkyl or substituted alkyl containing from about 1 to about 4 carbon atoms, preferably groups selected from the group consisting of methyl, ethyl, propyl, hydroxy substituted ethyl and propyl and mixtures thereof, more preferably methyl, ($R^2$) is selected from the group consisting of hydrogen and hydroxyl groups, and n is a number from about 1 to about 4, preferably about 1. A highly preferred low residue surfactant of this type is Empigen BB®, a coco dimethyl betaine produced by Albright & Wilson.

In another equally preferred embodiment, these betaine surfactants have the generic formula:

$$R—C(O)—N(R^2)—(CR^3{}_2)_n—N(R^2)_2{}^+—(CR^3{}_2)_n—COO^-,$$

wherein each R is a hydrocarbon, e.g., an alkyl group containing from about 6 to about 20, preferably up to about 18, more preferably up to about 16 carbon atoms, each ($R^2$) is either a hydrogen (when attached to the amido nitrogen), short chain alkyl or substituted alkyl containing from about 1 to about 4 carbon atoms, preferably groups selected from the group consisting of methyl, ethyl, propyl, hydroxy substituted ethyl and propyl and mixtures thereof, more preferably methyl, each ($R^3$) is selected from the group consisting of hydrogen and hydroxyl groups, and each n is a number from about 1 to about 4, more preferably about 2 or about 3, most preferably about 3, with no more than about 1 hydroxy group in any ($CR^3{}_2$) moiety. The R group can be linear or branched, saturated or unsaturated. The $R^2$ groups can also be connected to form ring structures. A highly preferred low residue surfactant of this type is TEGO Betain F®, a coco amido propyl betaine produced by Degussa-Goldschmidt.

The third class of preferred low-residue surfactants comprises the group consisting of amphoteric surfactants. These surfactants function essentially as zwitterionic surfactants at acidic pH. One suitable amphoteric surfactant is a C8–C16 amido alkylene glycinate surfactant ('ampho glycinate'). Another suitable amphoteric surfactant is a C8–C16 amido alkylene propionate surfactant ('ampho propionate'). These surfactants are essentially cationic at acidic pH and have the generic structure:

$$R—C(O)—(CH_2)_n—N(R^1)—(CH_2)_t—COOH,$$

wherein R—C(O)— is a about C5 to about C15, pre hydrophobic fatty acyl moiety, each n is from about 1 to about 3, each R1 is preferably hydrogen or a C1–C2 alkyl or hydroxyalkyl group, and x is about 1 or about 2. Such surfactants are available, in the salt form, from Degussa-Goldschmidt chemicals under the tradename Rewoteric AM®. Examples of other suitable low residue surfactants include cocoyl amido ethyleneamine-N-(methyl) acetates, cocoyl amido ethyleneamine-N-(hydroxyethyl) acetates, cocoyl amido propyleneamine-N-(hydroxyethyl) acetates, and analogs and mixtures thereof.

Other suitable, amphoteric surfactants being either cationic or anionic depending upon the pH of the system are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378, said patents being incorporated herein by reference.

Low-residue surfactants contribute to the filming/streaking performance (i.e., low or substantially no streaks- and/or film-formation) of the compositions according to the present invention. Whilst not wishing to be limited by theory, it is believed that the bulky sugar moieties of alkyl polyglycosides and sucrose esters function to inhibit the aggregation of surfactant that occurs upon evaporation of water in the aqueous solutions of the present invention. It is also believed that the zwitterionic and amphoteric surfactants show reduced aggregation relative to conventional surfactants because the intra-molecular electrostatic attractions between the anionically and cationically charged groups are stronger than the intermolecular surfactant-surfactant attractions. This results in a reduced tendency for molecular assembly that inhibits visible residue.

In a preferred embodiment according to the present invention, the low-residue surfactant herein is selected in order to provide an Extracompa® black shiny porcelain tile treated with the composition herein with a gloss-meter reading such that at a 95% confidence level, the composition does not cause a significant loss in gloss on the tiles, relative to clean untreated tiles, when tested with a BYK gloss-meter® using a 60° angle setting. The above test is performed as described herein below.

By 'not significant loss in gloss', it is meant herein that the mean difference in gloss between tiles treated with two separate treatments using 15 readings for each is not statistically significant ($\alpha$=0.05). Similarly, by 'significant enhancement (or gain) in gloss', it is meant herein that the mean difference in gloss between tiles treated with two separate treatments using 15 readings for each is statistically significant ($\alpha$=0.05). In these filming/streaking tests, statistical significance is established at the 95% confidence level ($\alpha$=0.05), using a one-tailed test and pair-wise statistical treatment of the samples. All samples are assumed to exhibit a normal distribution with equal variances. Using the raw data, t-tests are calculated and compared to the critical t statistic. When the calculated t-test exceeds t-critical, the samples are 'significantly' different. When t-calculated is less than t-critical, the samples are not 'significantly' different. The direction of the significance is determined by sign of the mean differences (i.e., 'either mean treatment $\delta$', 'mean $\delta$ (PHMB-noPHMB)' or 'mean $\delta$ (PHMB-Quat)'. For example, if the mean gloss for a treatment is higher than that of the untreated tile, and t-calculated exceeds t-critical, then the data suggest that at a 95% confidence level ($\alpha$=0.05) the treatment has a significantly higher gloss than the untreated tile. The statistics treatment of dependent paired samples ('mean treatment $\delta$') and independent paired samples ('mean $\delta$ PHMB-noPHMB' or 'mean $\delta$ (PHMB-Quat') can be found in Anderson, Sweeney and Williams, *Statistics for Business and Economics,* $6^{th}$ edition, West Publishing Company, 1996, incorporated herein by reference. The statistics can be conveniently run using the statistical function in Microsoft Excel®. Excel provides a P-value, which corresponds to the level of significance of the results. P-values below 0.05 indicate statistical significance at $\alpha$=0.05; P-values above 0.05 indicate no statistical significance at $\alpha$=0.05.

In another preferred embodiment according to the present invention, the low residue surfactant herein is selected in order to provide an Extracompa® black shiny ceramic tile treated with the compositions herein with a gloss-meter reading such that at a 95% confidence level, the composition causes a significant enhancement/gain of gloss, relative to tiles treated with a similar composition not comprising the polymeric biguanide, when tested with a BYK gloss-meter® using a 60° angle setting. The above test is performed as described herein below.

Low-residue surfactants can be present in the compositions of this invention at levels from about 0.01% to about 15%, preferably of from about 0.01% to about 10%, and more preferably of from about 0.03% to about 0.75% by weight of the total composition. At actual product use levels, following recommended product dilution, if any, the low-residue surfactants are typically present at levels from about 0.01% to about 1.5%, more preferably from about 0.01% to about 10%, and more preferably of from about 0.03% to about 0.75% by weight of the total composition. Importantly, the Applicant has found that the use of a low residue surfactant in combination with a conventional surfactant (i.e., non-low residue) can mitigate filming and/or streaking issues relative to similar compositions that only use the conventional surfactant.

Polymeric Biguanide:

As an essential ingredient the composition according to the present invention comprises a polymeric biguanide. Any polymeric biguanide known to those skilled in the art may be used herein.

Polymeric biguanides are characterised in comprising at least one, preferably about 2 or more, biguanide moieties according to the following formula:

$$—NH—C(=NH)—NH—C(=NH)—NH—$$

In the context of the compositions of this invention, the polymeric biguanide are oligo- or poly alkylene biguanides or salts thereof or mixtures thereof. More preferred polymeric biguanides are oligo- or poly hexamethylene biguanides or salts thereof or mixtures thereof.

In a most preferred embodiment according to the present invention said polymeric biguanide is a poly (hexamethylene biguanide) or salt thereof according to the following formula:

$$—[—(CH_2)_3—NH—C(=NH)—NH—C(=NH)—NH—(CH_2)_3—]_n—$$

wherein n is an integer selected from about 1 to about 50, preferably about 1 to about 20, more preferably about 9 to about 18. More preferably said biguanide antimicrobial agents is a salt of a poly (hexamethylene biguanide) according to the following formula:

$$—[—(CH_2)_3—NH—C(=NH)—NH—C(=NH)—NH—(CH_2)_3—]_n—.nHX$$

wherein n is an integer selected from about 1 to about 50, preferably about 1 to about 20, more preferably about 9 to about 18, and HX is salt component, preferably HCl.

None of the non-polymeric materials will work—the polymer is needed for wetting.

A most preferred poly (hexamethylene biguanide) hydrochloride (PBG) wherein in the above formula n=12, is commercially available under the trade name Vantocil P®, Vantocil IB® or Cosmocil CQ® from Avecia. Another suitable PHMB wherein n=15, is commercially sold by Avecia under the tradename Reputex 20®. The choice of poly (hexamethylene biguanide) hydrochloride, as the most preferred polymeric biguanide antimicrobial for the compositions of this invention is driven by its unusually good filming and streaking properties within the scope of the compositions disclosed herein, and by its regulatory status as an approved antimicrobial active for hard surface cleaning applications in the European Union (Biocidal Products Directive) and in the United States (EPA actives list).

The Applicant has found that the micro-effectiveness of PHMB is optimized at relatively low concentrations of organic acid. For example, the effectiveness of PHMB as an antimicrobial active in a composition of the invention comprising about 0.25% citric acid is enhanced relative to a similar composition comprising 1% citric acid. This is advantageous since lower concentrations of acid tend to result in improved filming and streaking benefits, all while promoting good antimicrobial efficiency.

Typically the compositions herein may comprise up to about 20%, preferably from about 0.01% to about 10%, more preferably from about 0.02% to about 7.5%, by weight of the total composition of a polymeric biguanide. At the actual product use levels, following recommended product dilution, if any, the compositions herein may comprise up to about 2%, preferably from about 0.01% to about 1%, more preferably from about 0.02% to about 0.75%, by weight of the total composition of a polymeric biguanide. Those skilled in the art will appreciate that the level of polymeric biguanide antimicrobial agent is dependent on the magnitude of the antimicrobial benefits sought. For hygiene claims in Europe, and sanitization, and 'Limited Disinfection' benefits in Canada and the United States, lower levels of polymeric biguanide antimicrobial agent, up to about 0.20%, are sufficient. For complete biocidal effectiveness against Gram positive and Gram negative micro-organisms, it is recommended that at least about 0.20%, more preferably about 0.25% most preferably about 0.30% polymeric biguanide compound be included in the aqueous composition. Higher levels of biguanide antimicrobial agent may be needed, up to about 1.5%, for particularly tough to kill microorganisms such as *Trychophyton* or other fungi.

Optional Components

Surfactant:

The compositions of the present invention can incorporate, in addition to the essential low-residue surfactants, 'non low-residue' surfactants. These can be non-ionic, anionic, cationic, zwitterionic or amphoteric, and mixtures thereof. The required surfactant is defined as any material with a hydrophobic component consisting of a hydrocarbon moiety with between about 6 carbon atoms and about 20 carbon atoms, and a hydrophilic head group. The purpose of the surfactant is improved wetting of the hard surfaces to be treated. The wetting properties of the surfactant are essential to the compositions of the invention. The hydrophobic tail of the surfactant can be linear or branched, aliphatic aromatic. The hydrophilic head group can consist of any group such that provides wetting properties. Said surfactant may be present in the compositions according to the present invention in amounts of from about 0.01% to about 15%, preferably of from about 0.01% to about 10%, and more preferably of from about 0.02% to about 7.5% by weight of the total composition. At actual product use levels, the low residue surfactants are typically present at levels from about 0.01% to about 1.5%, more preferably from about 0.01% to about 10%, and more preferably of from about 0.03% to about 0.75% by weight of the total composition.

More specifically, groups of non-ionic surfactants that can be used in the context of the following invention are as follows:

(i) The polyethylene oxide condensates of alkyl phenols, e.g., the condensation products of alkyl phenols having an alkyl group containing from about 6 to about 12 carbon atoms in either a straight chain or branched chain configuration, with ethylene oxide, the said ethylene oxide being present in amounts equal to about 10 to about 25 moles of ethylene oxide per mole of alkyl phenol. The alkyl substituent in such compounds may be derived from polymerized propylene, diisobutylene, octane, and nonane.

(ii) Those derived from the condensation of ethylene oxide with the product resulting from the reaction of propylene oxide and ethylene diamine products, which may be varied, in composition depending upon the balance between the hydrophobic and hydrophilic elements, which is desired. Examples are to increase the water-solubility of the molecule as a whole and the liquid character of the products is retained up to the point where polyoxyethylene content is about 50% of the total weight of the condensation product; compounds containing from about 40% to about 80% polyoxyethylene by weight and having a molecular weight of from about 5000 to about 11000 resulting from the reaction of ethylene oxide groups with a hydrophobic base constituted of the reaction product of ethylene diamine and excess propylene oxide, said base having a molecular weight of the order of about 2500 to about 3000.

(iii) The condensation product of aliphatic alcohols having from about 6 to about 18 carbon atoms, in either straight chain or branched chain configuration, with ethylene oxide, propylene oxide, butylene oxide, and mixtures thereof, e.g., a coconut alcohol ethylene oxide condensate having from about 3 to about 15 moles of ethylene oxide per mole of coconut alcohol, the coconut alcohol fraction having from about 10 to about 14 carbon atoms; such materials are commonly known as 'alkyl alkoxylates' or 'alcohol alkoxylates'. In some cases, an alkyl ethoxylates can have capping groups, meaning that they have the structure $R1\text{-}(EO)_xR2$, where R1 is a C6–C18 linear or branched moiety, x is from about 1 to about 15 and R2, the capping group, is a about C1 to about C8 hydrocarbyl moiety.

(iv) Trialkyl amine oxides and trialkyl phosphine oxides wherein one alkyl group ranges from about 10 to about 18 carbon atoms and two alkyl groups range from about 1 to about 3 carbon atoms; the alkyl groups can contain hydroxy substituents; specific examples are dodecyl di(2-hydroxyethyl)amine oxide and tetradecyl dimethyl phosphine oxide.

Although not preferred, the condensation products of ethylene oxide with a hydrophobic base formed by the condensation of propylene oxide with propylene glycol are also suitable for use herein. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein x, y, and z are from about 1 to about 100, preferably about 3 to about 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF and incorporated herein by reference.

Also not preferred, although suitable as non-ionic surfactants herein are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2,500 to about 3,000. This hydrophobic moiety is condensed with ethylene oxide to the extent that the condensation product contains from about 40% to about 80% by weight of polyoxyethylene and has a molecular weight of from about 5,000 to about 11,000. Examples of this type of non-ionic surfactant include certain of the commercially available Tetronic® compounds, marketed by BASF.

Other non-ionic surfactants, though not preferred, for use herein include polyhydroxy fatty acid amides of the structural formula:

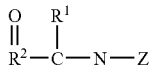

(I)

wherein: $R^1$ is H, C1–C4 hydrocarbyl, 2-hydroxy ethyl, 2-hydroxypropyl, or a mixture thereof, preferably $C_1$–$C_4$ alkyl, more preferably C1 or C2 alkyl, most preferably C1 alkyl (i.e., methyl);

and $R^2$ is a C5–C31 hydrocarbyl, preferably straight chain C7–C19 alkyl or alkenyl, more preferably straight chain C9–C17 alkyl or alkenyl, most preferably straight chain C11–C17 alkyl or alkenyl, or mixtures thereof; and Z is a polyhydroxyhydrocarbyl having a linear hydrocarbyl chain with at least about 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup can be utilised as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from about 3 to about 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl, $R^2—CO—N<$ can be, for example, cocamide, stearamide, oleamide, lauramide, myristamide, capricamide, palmitamide, tallowamide, etc., Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Another type of suitable non-ionic surfactants for use herein are the 2-alkyl alkanols having an alkyl chain comprising from about 6 to about 16, preferably from about 7 to about 13, more preferably from about 8 to about 12, most preferably from about 8 to about 10 carbon atoms and a terminal hydroxy group, said alkyl chain being substituted in the α position (i.e., position number 2) by an alkyl chain comprising from about 1 to about 10, preferably from about 2 to about 8 and more preferably about 4 to about 6 carbon atoms.

Such suitable compounds are commercially available, for instance, as the Isofol® series such as Isofol® 12 (2-butyl octanol) or Isofol® 16 (2-hexyl decanol) commercially available from Condea.

A detailed listing of suitable non-ionic surfactants useful in this invention can be found in U.S. Pat. No. 4,557,853, Collins, issued Dec. 10$^{th}$, 1985 and incorporated herein by reference.

Among non-low residue non-ionic surfactants, those formed by the reaction of an alcohol with one or more ethylene oxides, are most preferred. These surfactants are prone to form highly visible films in the absence of polymeric biguanides. However, the Applicant has found that addition of low to moderate levels (e.g., about 0.05% to about 0.30%) of the biguanides of the invention to compositions results in significant toning of the visible film, and leads to enhanced gloss on tile that is aesthetically pleasing. In effect, the polymeric biguanides of the invention are effective and efficient in removing alkyl ethoxylate-produced visible films from tiles. Non-limiting examples of groups of these preferred non-low residue alkyl alkoxylates include Neodol® surfactants (Shell), Tergitol® surfactants (Union Carbide) and Icconol® surfactants (BASF). One specific example is Neodol 91-6®, an alkyl ethoxylate comprising from 9 to 11 carbon atoms and an average of 6 moles of ethoxylation made by Shell.

Anionic surfactants are not preferred, particularly as stand-alone surfactants, but can also be used in the present invention. Suitable anionic surfactants for use herein include alkali metal (e.g., sodium or potassium) fatty acids, or soaps thereof, containing from about 8 to about 24, preferably from about 10 to about 20 carbon atoms, linear of branched C6–C16 alcohols, C6–C12 alkyl sulfonates, C6–C18 alkyl sulfates 2-ethyl-1-hexyl sulfosuccinate, C6–C16 alkyl carboxylates, C6–C18 alkyl ethoxy sulfates.

The fatty acids including those used in making the soaps can be obtained from natural sources such as, for instance, plant or animal-derived glycerides (e.g., palm oil, coconut oil, babassu oil, soybean oil, castor oil, tallow, whale oil, fish oil, tallow, grease, lard and mixtures thereof). The fatty acids can also be synthetically prepared (e.g., by oxidation of petroleum stocks or by the Fischer-Tropsch process). Alkali metal soaps can be made by direct soapification of fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

Other suitable anionic surfactants for use herein include water-soluble salts, particularly the alkali metal salts, of organic sulphuric reaction products having in the molecular structure an alkyl radical containing from about 8 to about 22 carbon atoms and a radical selected from the group consisting of sulfonic acid and sulphuric acid ester radicals. Important examples of these synthetic detergents are the sodium, ammonium or potassium alkyl sulfates, especially those obtained by sulfating the higher alcohols produced by reducing the glycerides of tallow or coconut oil; sodium or potassium alkyl benzene sulfonates, in which the alkyl group contains from about 9 to about 15 carbon atoms, especially those of the types described in U.S. Pat. Nos. 2,220,099 and 2,477,383, incorporated herein by reference; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulphuric acid esters of the reaction product of one mole of a higher fatty alcohol (e.g., tallow or coconut oil alcohols) and about three moles of ethylene oxide; sodium or potassium salts of alkyl phenol ethylene oxide ether sulfates with about four units of ethylene oxide per molecule and in which the alkyl radicals contain about 9 carbon atoms; sodium or potassium salts of alkyl ethylene oxide ether sulfates with about four units of ethylene oxide per molecule and in which the alkyl radicals contain 6 to 18 carbon atoms; the reaction product of fatty acids esterified with isothionic acid and neutralized with sodium hydroxide where, for example, the fatty acids are derived from coconut oil; sodium or potassium salts of fatty acid amide of a methyl taurine in which the fatty acids, for example, are derived from coconut oil; and others known in the art, a number being specifically set forth in U.S. Pat. Nos. 2,486,921, 2,486,922 and 2,396,278, incorporated herein by reference. Other suitable anionic surfactants include C6–C18 alkyl ethoxy carboxylates, C8–C18 methyl ester sulfonates, 2-ethyl-1-hexyl sulfosuccinamate, 2-ethyl-1-hexyl sulfosuccinate and the like.

Cationic surfactants are not preferred but can be used at low levels in compositions of the present invention are those having a long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

Solvents

As an optional but highly preferred ingredient the composition herein comprises one or more solvents or mixtures thereof. Solvents can provide improved filming and/or streaking benefits. Whilst not wishing to be limited by theory, it is believed that solvents disrupt micelle formation, thus reducing surfactant aggregation. As such, they act as gloss toning agents, reducing gloss loss or promoting gloss gain on the surfaces of the present invention. Solvents are also beneficial because of their surface tension reduction properties help the cleaning profile of the compositions disclosed herein. Finally, solvents, particularly solvents with high vapour pressure, specifically vapour pressures of about 0.05 mm Hg at 25° C. and 1 atmosphere pressure (about 6.66 Pa) or higher, can provide cleaning and filming and/or streaking benefits without leaving residue.

Solvents for use herein include all those known in the art for use in hard-surface cleaner compositions. Suitable solvents can be selected from the group consisting of: aliphatic alcohols, ethers and diethers having from about 4 to about 14 carbon atoms, preferably from about 6 to about 12 carbon atoms, and more preferably from about 8 to about 10 carbon atoms; glycols or alkoxylated glycols; glycol ethers; alkoxylated aromatic alcohols; aromatic alcohols; terpenes; and mixtures thereof. Aliphatic alcohols and glycol ether solvents are most preferred, particularly those with vapour pressure of about 0.05 mm Hg at 25° C. and 1 atmosphere pressure (about 6.66 Pa).

Aliphatic alcohols, of the formula R—OH wherein R is a linear or branched, saturated or unsaturated alkyl group of from about 1 to about 20 carbon atoms, preferably from about 2 to about 15 and more preferably from about 5 to about 12, are suitable solvents. Suitable aliphatic alcohols are methanol, ethanol, propanol, isopropanol or mixtures thereof. Among aliphatic alcohols, ethanol and isopropanol are most preferred because of their high vapour pressure and tendency to leave no residue.

Suitable glycols to be used herein are according to the formula HO—CR1R2—OH wherein R1 and R2 are independently H or a C2–C10 saturated or unsaturated aliphatic hydrocarbon chain and/or cyclic. Suitable glycols to be used herein are dodecaneglycol and/or propanediol.

In one preferred embodiment, at least one glycol ether solvent is incorporated in the compositions of the present invention. Particularly preferred glycol ethers have a terminal C3–C6 hydrocarbon attached to from one to three ethylene glycol or propylene glycol moieties to provide the appropriate degree of hydrophobicity and, preferably, surface activity. Examples of commercially available solvents based on ethylene glycol chemistry include mono-ethylene glycol n-hexyl ether (Hexyl Cellosolve®) available from Dow Chemical. Examples of commercially available solvents based on propylene glycol chemistry include the di-, and tri-propylene glycol derivatives of propyl and butyl alcohol, which are available from Arco under the trade names Arcosolv® and Dowanol®.

In the context of the present invention, preferred solvents are selected from the group consisting of mono-propylene glycol mono-propyl ether, di-propylene glycol mono-propyl ether, mono-propylene glycol mono-butyl ether, di-propylene glycol mono-propyl ether, di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, and mixtures thereof. "Butyl" includes normal butyl, isobutyl and tertiary butyl groups. Mono-propylene glycol and mono-propylene glycol mono-butyl ether are the most preferred cleaning solvent and are available under the tradenames Dowanol DPnP® and Dowanol DPnB®. Di-propylene glycol mono-t-butyl ether is commercially available from Arco Chemical under the tradename Arcosolv PTB®.

In a particularly preferred embodiment, the cleaning solvent is purified so as to minimize impurities. Such impurities include aldehydes, dimers, trimers, oligomers and other by-products. These have been found to deleteriously affect product odour, perfume solubility and end result. The inventors have also found that common commercial solvents, which contain low levels of aldehydes, can cause irreversible and irreparable yellowing of certain hard surfaces. By purifying the cleaning solvents so as to minimize or eliminate such impurities, surface damage is attenuated or eliminated.

Though not preferred, terpenes can be used in the present invention. Suitable terpenes to be used herein monocyclic terpenes, dicyclic terpenes and/or acyclic terpenes. Suitable terpenes are: D-limonene; pinene; pine oil; terpinene; terpene derivatives as menthol, terpineol, geraniol, thymol; and the citronella or citronellol types of ingredients.

Suitable alkoxylated aromatic alcohols to be used herein are according to the formula R-$(A)_n$-OH wherein R is an alkyl substituted or non-alkyl substituted aryl group of from about 1 to about 20 carbon atoms, preferably from about 2 to about 15 and more preferably from about 2 to about 10, wherein A is an alkoxy group preferably butoxy, propoxy and/or ethoxy, and n is an integer of from about 1 to about 5, preferably about 1 to about 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from about 1 to about 20 carbon atoms, preferably from about 1 to about 15 and more preferably from about 1 to about 10. For example a suitable aromatic alcohol to be used herein is benzyl alcohol.

When present, solvents are found to be most effective at levels from about 0.5% to about 25%, more preferably about 1.0% to about 20% and most preferably, about 2% to about 15%.

Hydrotropes:

Hydrotropes are advantageously used to ensure solubility of the aqueous composition compositions, and in particular to ensure adequate perfume solubility. Hydrotropes include the sulfonates of toluene, xylene and cumene, sulfates of naphthalene, anthracene, and higher aromatics, and C3–C10 linear or branched alkyl benzenes, C6–C8 sulfates such as hexyl sulfate and 2-ethyl-1-hexyl sulfate, short chain pyrrolidones such as octyl pyrrolidone, and the like. Other preferred hydrotropes include the oligomers and polymers comprising polyethylene glycol. In a particularly preferred embodiment, alkyl ethoxylates comprising at least an average of about 15 moles of ethylene oxide, more preferably at least about 20 moles of ethylene oxide per mole chain length (alcohol) are advantageously employed. Unlike conventional hydrotropes, the preferred alkyl ethoxylate hydrotropes are found to have little or no impact on the filming and streaking properties of the compositions of the present invention. When present, hydrotropes are preferably used at solution weight percent of from about 0.01% to about 5%, more preferably about 0.01% to about 0.5%, still more preferably about 0.03% to about 0.25%.

The liquid compositions according to the present invention may comprise a variety of other optional ingredients depending on the technical benefit aimed for and the surface treated. Suitable optional ingredients for use herein include polymers, buffers, perfumes, colorants, pigments and/or dyes.

Filming/Streaking, Cleaning and Antimicrobial Performance

The Applicant has found that the compositions according to the present invention comprising a pH of about 7 or less, surfactant(s) and the polymeric biguanide show very low or even no filming/streaking ("filming/streaking performance benefit") when used on a hard surface, preferably when used on a shiny hard surface. The overall filming and streaking profiles of surfaces treated with the compositions of the invention benefits are particularly good when the surfactant is a low residue surfactant.

So as to reduce the overall level of filming and/or streaking while still providing antimicrobial benefits in a hard surface cleaner context, proper selection of the components in the aqueous solution is essential. The polymeric biguanide induces substantially no, preferably no, incremental visible film or streak negatives when used in combination with a composition with pH of about 7 or less and surfactant as described herein to treat a hard surface. Without being bound by theory, it is believed that the polymeric biguanide compound acts as a wetting polymer at pH of about 7 or less and in the presence of surfactant. As such, it functions as a hydrophilic agent, helping evenly distribute the aqueous composition throughout the surface to be treated. It is believed that the polymeric biguanide forms a colorless, uniform film on the treated hard surfaces, attenuating or masking the streaks and/or films due to other components in the composition, or enhancing the shine/gloss of the treated surface when the other components in the composition do not cause streaking and/or filming issues. Additionally, the biguanide compound does not interact very strongly with charged surfaces, meaning that the primary interaction is between surfactants, solvents (i.e., cleaning agents) and the surface to be treated. As a result, the biguanide compound has a lower tendency to bind on hard surfaces and leave films and streaks. The wetting ability of the polymeric biguanide material in this context is very surprising given that the alternative cationic antimicrobial actives, quaternary ammonium surfactants, are very poor wetting compounds. By quaternary ammonium surfactants, it is meant all surfactants of the form $R1R2R3R4N^+$, wherein R1 is a C8 to C18 alkyl group, R2 and R3 are C1 to C18 alkyl groups, benzyl groups or substituted benzyl groups and R4 is a methyl group. Such materials are widely available commercially and are sold by Lonza Corporation and Stepan Corporation as effective antimicrobial compounds. Quaternary ammonium compounds exhibit hydrophobic behavior in aqueous media. As such, they de-wet the surfaces being treated. This leads to non-uniform cleaning and drying, and undesirable accelerated aggregation of the solids on the surfaces upon evaporation of the water from the aqueous composition. This leads to high levels of streaks. Moreover, quaternary ammonium compounds are highly charged chemical species that will bind to negatively charged surfaces, including glass and ceramic. Once bound to these surfaces, their removal can require use of a second treatment comprising anionic surfactants and the like, for removal of the quaternary ammonium compounds (quats). This is highly undesirable. In one-step cleaning applications, quats will build up on negatively charged surfaces. The polymeric biguanide compounds, within the framework provided by the compositions of this invention, are excellent wetting agents and do not strongly bind anionic surfaces. The polymeric biguanide surface film is clean and strip-able, meaning that it is easily removed and replaced in subsequent cleaning applications. Additionally, the hydrophilic nature of the polymer helps the wetting of floors in next-time cleaning applications. In instances wherein the polymeric biguanides are used to clean vertical tiles (for example bathroom shower tiles), the compositions "sheet" water very well ensuring even-ness of cleaning or easier rinsing of tiles.

The magnitude of the gloss improvement provided by the polymeric biguanides of the present invention, relative to similar compositions not comprising polymeric biguanides, will depend on the level of polymer incorporated. Increased levels of polymer will provide increased gloss. The Applicant has found that it is relatively straightforward to increase the gloss of untreated tiles with the compositions herein when said compositions comprise, at usage levels, at least about 0.3% polymeric biguanide and more preferably at least about 0.5% polymeric biguanide. The exact level will depend upon the nature of the cleaning tool used in the cleaning process. Cleaning tools that tend to absorb the polymeric biguanide will also reduce the amount deposited on hard surfaces. Examples are string and strip cellulosic cleaning tools, and wipe laminates such as Swiffer Wet®.

Despite the hydrophilic behavior on surfaces, the polymeric biguanides within the context of the compositions of the invention are shown to exhibit strong antimicrobial properties comparable to those of quaternary ammonium surfactants.

According to the present invention, the compositions are selected so as to maximize the gloss on a standard black shiny porcelain tile described hereinafter. The Applicant has found that the polymeric biguanide compound assists in gloss enhancement or retention. More specifically, the gloss readings provided by compositions that comprise the polymeric biguanide compound are equal or better than the gloss readings provided by identical compositions lacking the polymeric biguanide compound. Even more surprisingly, the compositions of the invention provide gloss retention or enhancement of clean untreated tiles. That is, the polymeric biguanide compound preserves or enhances the shine benefits of the clean tiles.

Aqueous compositions comprising low-residue surfactant, lotion pH of about 7 or less, and polymeric biguanide compound are found to provide effective antimicrobial properties and excellent filming and streaking attributes when wiped on hard surfaces. That is, according to the present invention, aqueous acidic hard surface cleaning compositions comprising low residue surfactant and polymeric biguanide compounds can be used with traditional cleaning tools, including but not limited to, sponges, cloths, cellulose strings and strips, paper, commercially available paper towels, soft or scouring pads, brushes, and the like. These cleaning tools can optionally be used in combination with an implement for increased ease of use and improved area coverage. In one application the compositions are packaged in a bottle or other container as concentrated product, and are then diluted with water, optionally in a bucket, prior to being used as cleaning compositions. In a particularly preferred embodiment, the aqueous compositions are provided in the form of a "spray and mop" product. In this context, the liquid compositions are packaged in bottle or other receptacle that allows easy dosing directly on floors, preferably by spraying, then by wiped using a conventional mop or other cleaning implement. "Spray and mop" kits may be sold as a combined package comprising lotion and cleaning implement, or as liquid cleaner solution to be used in conjunction with implements or cleaning cloths or pads as desired by individual users. The compositions may be packaged and marketed in the form of floor wipes comprising said compositions. In another highly preferred embodiment, the aqueous compositions herein are used conjunction with an absorbent disposable cleaning pad.

Packaging Form of the Aqueous Compositions

The aqueous compositions can be packaged in any container that allows proper dispensing of product. Such packages include, but are not limited to capped bottled, and spray bottles. The packages can be made of any material known in the art, such as plastic or glass.

In a preferred embodiment, the aqueous compositions are sold in combination with other cleaning tools and/or implements. For example, the compositions can be sold together with sponges or sponge mops. Alternatively, the compositions are bundled with commercial paper towels, or with string or strip mops. In one preferred embodiment, the aqueous compositions are packaged in spray bottles and bundled, or co-branded with a cleaning implement (spray and mop application). In a highly preferred embodiment, the aqueous compositions of the present invention are packaged with absorbent disposable cleaning pads and/or cleaning implements. Kits can also be sold where such pads are combined with a dispensing bottle containing aqueous compositions of the invention, optionally packaged together with a cleaning implement. These latter embodiments can be advantageously marketed and sold as 'starter kits', designed to help consumers leverage all of the power of the aqueous compositions.

Process for Cleaning a Surface

In a preferred embodiment, the present invention encompasses a process of cleaning a surface, preferably a hard surface, comprising the step of contacting, preferably wiping, said surface using an aqueous composition of the present invention. In a preferred embodiment of the present application, said process comprises the steps of contacting parts of said surface, more preferably soiled parts of said surface, with said aqueous composition. By "hard-surfaces", it is meant herein any kind of surfaces typically found in houses like kitchens, bathrooms, or in car interiors or exteriors, e.g., floors, walls, tiles, windows, sinks, showers, shower plastified curtains, wash basins, WCs, dishes, fixtures and fittings and the like made of different materials like ceramic, vinyl, no-wax vinyl, linoleum, melamine, glass, any plastics, plastified wood, metal or any painted or varnished or sealed surface and the like. Hard-surfaces also include household appliances including, but not limited to, refrigerators, freezers, washing machines, automatic dryers, ovens, microwave ovens, dishwashers and so on.

Test Methodologies

The filming and streaking test methodologies shown below illustrate the benefits of the compositions of the present invention.

Filming and Streaking for Conventional Cleaning Tools: Sponges

Test Tiles:

Extracompa® black glossy ceramic tiles, obtained from Senio (via Tarroni 1 48012 Bagnacavallo (RA), Italy), with dimensions 20 cm×20 cm×1 cm are employed as the test surface. Prior to use, the tile surfaces are washed with soap and water. They are then rinsed with about 500 ml distilled water and wiped dry using paper towel, preferably using a low-binder clean paper towel such as Scott® paper towels.

Approximately five milliliters of a 50% water, 50% 2-propanol solution mix is applied from a squirt bottle to the surface of the tiles, spread to cover the entire tile using clean paper towel and then wiped to dryness with more paper towel. The application of the water/2-propanol treatment is repeated and the tiles are allowed to air dry for five minutes. The test tiles are positioned on a horizontal surface, completely exposing the ceramic surface prior to testing. Prior to initiating the wiping with test products, the tiles gloss readings for the cleaned tiles are measured and recorded. The measurement is performed using a 'BYK Gardner micro-TRI-gloss®' gloss-meter using the 60° angle setting. The gloss-meter is manufactured by BYK-Gardner, and is available under catalog number is GB4520. The gloss of each tile is analytically measured at the four corners and the center of the tile, and the readings averaged. Tests are then conducted on single test tiles with a total of 3 replicates to ensure reproducibility.

Test Sponges:

So as to exemplify the use of conventional implements with the aqueous compositions of the present invention, the following protocol is used for sponges. Sponges with dimensions 14 cm×9 cm×2.5 cm purchased from VWR Scientific, catalog No. 58540-047, cut to size by cutting each sponge in thirds along the width of the sponge, washed in a conventional washing machine with detergent and then washed in plain water in a washing machine 3 times so as to strip the sponge finishes. The sponges are then allowed to dry in a working fume hood for 48 hours. The dimensions of the dry sponges after air-drying are about 9 cm×4.5 cm×2.5 cm. Dry test sponges are weighed (5±1 grams). Distilled water is then added at a load factor of 2 grams water per gram sponge so as moisten the sponge. Using a disposable pipette, the damp sponges are then dosed with 3 ml of test product. The dosing is done so as to evenly cover one of the four large faces of the sponge (area of about 14 cm×9 cm), preferably the one with the smallest size visible pores.

Wiping Procedure:

A hand-held damp sponge is then positioned with the length of the sponge (i.e., 14 cm) positioned parallel to the top left-hand side of the tile, and is then made to wipe the tile from left to right, right to left, left to right, right to left, and left to right motions, proceeding from the upper left hand side of the tile to the lower right hand side of the tile, so as to as evenly as possible cover the whole tile. The wiping motion is made continuously from side to side as described above, and the final pass is completed past the end of the tile. The total wiping time is about 3–4 seconds.

Testing with other conventional cleaning tools can be conducted in analogous manner. For experiments conducted with paper and commercially available paper towels, the cleaning tools are not pre-moistened and the treatments are directly placed on tile. All conventional cleaning tools are constructed so as to have substantially similar length and width dimensions as the sponges herein described.

Grading:

Grading is performed within 30 minutes after the tiles have been wiped. For each test product (which consists of a and impregnated lotion), the wiping procedure described above is performed five times. The tiles are allowed to air dry at ambient conditions (20° C.–25° C. at a relative humidity of 40–50%) and then graded. Tiles are graded using visual grades and gloss-meter readings. Two sets of measurements are selected since the gloss-meter measurements allow for an analytical estimate of filming, while the visual grades advantageously employ human visual acuity for the identification of streaks and blotchy areas. The two grades are viewed as complementary and usually show similar trends. Visual grading is done with 5 expert panelists such that the panelists do not know the identity of the specific products tested. Visual grading of is conducted using a 0 to 4 scale, where 4 indicates a very streaky/filmy end result and 0 is a completely perfect end result. Tile residue is analytically measured using a 'BYK-Gardner micro-TRI-gloss®' gloss-meter using a 60° angle setting. The gloss-meter is manufactured by BYK-Gardner and is available as catalog item number GB-4520. Once the tiles are dry (air dried at ambient conditions), the gloss of each tile is analytically measured with the gloss-meter at the four corners and the center of the tile, and the readings averaged. The averages for each of the 3 tiles tested are computed and then averaged. This 'average of averages' is then compared to the 'average of averages' computed on the pre-cleaned tiles; the standard deviation for gloss loss (gain) is obtained using all 15 gloss readings, wherein each gloss measurement recorded corresponds to the difference between clean and treated tile (mean δ). The overall appearance of tiles will depend on both, the amount of streaking and the amount of filming on the tiles.

Filming and Streaking for Absorbent Disposable Cleaning Pads

Test Tiles:

The test tiles are prepared in the section entitled filming and streaking conventional cleaning tools: sponges.

Test Pads:

Pads used are those commercially available in the US as "Swiffer WETJET®". For the purposes of the test the pad is cut down to a dimension of 11.5×14.5 cm along the width of the pad in order to scale it down so it can effectively be used to clean the tile which has dimensions of 20 cm×20 cm×1 cm as described above. After cutting the edges, the pad is sealed with two-sided tape to prevent super-absorbent polymer from leaching out. The pad is then attached to a handle with a mop head. The implement head can be made using an implement such as that sold as "Swiffer®", taking the head portion only and cutting it down to 10.5×11.5 cm (thus creating a mini implement to go with the reduced size pads used in the experiments). The pad can be attached with tape onto the Swiffer® mini implement or with Velcro.

Wiping Procedure:

Prior to wiping the flaps on the WETJET® pad are opened as per usage instructions. Three ml of the test solution are then applied at the bottom of the tile (3 mm above edge of bottom) using a pipette and spread along the full width of the tile trying to achieve even coverage. The implement comprising the WETJET® pad is then placed over the solution at the bottom left hand corner of the tiles, and then made to wipe the complete surface of the test tiles in five uninterrupted over-lapping wipe motions: first from left to right, then repeated right to left. The wiping motion is made continuously from side to side as described above, and the final pass is completed past the end of the tile. On the last wiping strokes as the edge of the tile is reached, it is important that the flap on the leading edge of the WETJET® pad contacts the surface in order to smooth out the solution at the edges. Tests are conducted on single test tiles with a total of 3 replicates to ensure reproducibility. While a fresh aliquot of 3 ml of solution is applied to each test tile, the same pad is used for all replicates (pad has sufficient mileage to cleaning multiple tiles). Wiping time duration is about 5 seconds per tile.

Experimental Data and Examples

The following examples are meant to exemplify compositions used in a process according to the present invention but are not intended to limit or otherwise define the scope of the present invention. The aqueous compositions are made by combining the listed ingredients in the listed proportions to form homogenous mixtures (solution weight % unless otherwise specified).

The aqueous compositions A–P are used in conjunction with sponges for a general cleaning application, and are prepared from a base product lacking surfactant and polymeric biguanide. The base product includes: 0.05% C12–14 EO21, 0.5% citric acid, 2% propylene glycol n-butyl ether (Dowanol PnB®), 8% ethanol and 0.1% perfume, and the remainder, excluding the hole left for surfactant and polymer/antimicrobial agent, up to 100%, water. Surfactant and polymer/antimicrobial agent are then incorporated into the base product. Compositions A–P have a pH near 2.5.

Compositions Q–X are used in conjunction with a disposable absorbent pad to illustrate a floor cleaning application. The compositions are prepared from a base product lacking surfactant and polymeric biguanide. The base product includes: 0.125% citric acid (except compositions W and X), 2% propylene glycol n-butyl ether (Dowanol PnB), and 0.05% perfume, and the remainder, excluding the hole left for surfactant (0.03%) and polymer/antimicrobial agent (0.05% if present), up to 100%, water. Surfactant and polymer/antimicrobial agent are then incorporated into the base product. Compositions Q–V have a pH of about 2.5; compositions W and X have a pH of about 6.

Compositions AA–AH illustrate the benefits of the organic acid comprising at least one hydroxyl group within the scope of this invention. The base products for these compositions comprise: 0.22% C12–14 sulfobetaine, 0.05% C12–14 EO21, 0.5% acidifying agent (except for treatments AG and AH which use lower levels of inorganic acid), 2% propylene glycol n-butyl ether (Dowanol PnB), 8% ethanol and 0.1% perfume, and the remainder, excluding the hole left for polymeric biguanide, up to 100%, water. Compositions AA–AH have a pH of about 2.5.

Compositions used with Conventional Cleaning Tools: Sponges

| | A | B | C | D | E | F | G | H | I | J |
|---|---|---|---|---|---|---|---|---|---|---|
| Surfactants (%) | | | | | | | | | | |
| C12–14 sulfobetaine* | 0.22 | 0.22 | 0.22 | — | — | — | — | — | — | — |
| C8–16 APG** | — | — | — | 0.22 | 0.22 | 0.22 | — | — | — | — |
| Coco betaine*** | — | — | | — | — | — | 0.22 | 0.22 | — | — |
| C9–11EO6**** | — | — | — | — | — | — | — | — | 0.22 | 0.22 |
| Antimicrobials (%) | | | | | | | | | | |
| PHMB† | — | 0.3 | — | — | 0.3 | — | — | 0.3 | — | 0.3 |
| ADBAC‡ | — | — | 0.3 | — | — | 0.3 | — | — | — | — |

| | K | L | M | N | O | P |
|---|---|---|---|---|---|---|
| Surfactants (%) | | | | | | |
| Amphopropionate (V*) | 0.22 | 0.22 | — | — | — | 0.22 |
| C12–14 sulfobetaine**** | — | — | 0.22 | — | — | — |
| Coco betaine (V*) | — | — | — | 0.22 | | |
| C9–11EO6**** | — | — | — | — | 0.22 | — |
| Polymer (%) | | | | | | |
| PHMB† | — | 0.3 | 1.0 | 1.0 | 1.0 | 1.0 |

| | AA | AB | AC | AD | AE | AF | AG | AH |
|---|---|---|---|---|---|---|---|---|
| Surfactants (%) | | | | | | | | |
| C8–16 APG** | 0.22 | 0.22 | 0.22 | 0.22 | 0.22 | 0.22 | 0.22 | 0.22 |
| Organic Acid (%) | | | | | | | | |
| Tartaric acid | 0.5 | 0.5 | — | — | — | — | — | — |
| Lactic acid | — | — | 0.5 | 0.5 | — | — | — | — |
| DAGS[V] | — | — | — | — | 0.5 | 0.5 | — | — |
| Hydrochloric acid | — | — | — | — | — | — | 0.02 | 0.02 |
| Polymer (%) | | | | | | | | |
| PHMB† | — | 0.3 | — | 0.3 | — | 0.3 | — | 0.3 |

*Cocoamido propyl sulfobetaine made by Goldschmidt under the tradename Rewoteric CAS 15-U ®

**Alkyl PolyGlucoside made by Cognis under the tradename Plantaren 2000 ®

***C12–16 dimethyl betaine made by Albright & Wilson under the trade name Empigen BB/L ®

****Alkyl ethoxylate (6) made by Shell Chemical under the trade name Neodol 91-6 ®

(V*) N-coconut fatty acid amidoethyl N-hydroxyethyl amino propionic acid, sodium salt, made by Degussa-Goldschmidt under the trade name Rewoteric AM KSF 40 ®

†Poly (hexamethylene biguanide) made by Avecia under the tradename Vantocil IB ®

‡Alkyl Dimethyl Benzyl Ammonium Chloride made by Lonza under the tradename Barquat 4280 ®

[V]Diacids: Adipic, glutaric and succinic manufactured by Rhodia as a commercial mixture.

Compositions Used in Conjunction with Absorbent Disposable Cleaning Pads:

| | Q | R | S | T | U | V | W | X |
|---|---|---|---|---|---|---|---|---|
| Surfactants (%) | | | | | | | | |
| C12–14 sulfobetaine* | 0.03 | 0.03 | 0.03 | — | — | — | — | — |
| C8–16 APG** | — | — | — | 0.03 | 0.03 | 0.03 | 0.03 | 0.03 |
| Organic Acid (%) | | | | | | | | |
| Citric Acid | 0.125 | 0.125 | 0.125 | 0.125 | 0.125 | 0.125 | — | — |
| Antimicrobials (%) | | | | | | | | |
| PHMB† | — | 0.05 | — | — | 0.05 | — | — | 0.05 |
| ADBAC‡ | — | — | 0.05 | — | | 0.05 | — | — |

*Cocoamido propyl sulfobetaine made by Goldschmidt under the tradename Rewoteric CAS 15-U ®

**Alkyl PolyGlucoside made by Cognis under the tradename Plantaren 2000 ®

†Poly (hexamethylene biguanide) made by Avecia under the tradename Vantocil IB ®

‡Alkyl Dimethyl Benzyl Ammonium Chloride made by Lonza under the tradename Barquat 4280 ®

Filming and Streaking Experimental Results

The data below are tabulated in terms of gloss-meter measurements and visual grades. As indicated in the experimental section, the gloss-meter readings (mean treatment δ) are computed as a difference in gloss between tiles treated with the experimental compositions herein and that for the corresponding clean, untreated tiles. The clean tiles all have 60° angle gloss readings between 91 and 94. Gloss losses (gains) are computed as differences in readings. Positive values represent a loss in gloss. Negative values 0 suggest a gain in gloss. The mean gloss loss (gain) caused by treatments versus untreated tiles (mean treatment δ), and associated statistical significance are calculated. The mean gloss (gain) on tile caused by the addition of PHMB (mean δ (PHMB-noPHMB)) and associated statistical significance is also reported. The mean gloss (gain) on tile caused by poly (hexamethylene biguanide) versus quaternary ammonium surfactant (mean δ (PHMB-Quat)) and statistical significance are also reported.

In these tests, statistical significance is established at the 95% confidence level ($\alpha$=0.05), using a one-tailed test and pair-wise statistical treatment of the samples. All samples are assumed to exhibit a normal distribution with equal variances. Using the raw data, t-statistics are calculated and compared to the t-critical statistic. When the calculated t-test exceeds t-critical, the samples are 'significantly' different. When t-calculated is less than t-critical, the samples are not 'significantly' different. The direction of significance is determined by the sign of the mean differences (i.e., 'mean treatment δ', 'mean δ (PHMB-noPHMB)' or 'mean δ (PHMB-Quat)'. For example, if the treatment mean gloss for a treatment is higher than that of the untreated tile, and t-calculated exceeds t-critical, then the data suggest that at a 95% confidence level ($\alpha$=0.05) the treatment has a significantly higher gloss than the untreated tile. The statistic treatment of dependent paired samples (mean treatment δ) and independent paired samples ((PHMB-noPHMB or mean δ (PHMB-Quat)) can be found in Anderson, Sweeney and Williams, *Statistics for Business and Economics*, $6^{th}$ edition, West Publishing Company, 1996, incorporated herein by reference. The statistics can be conveniently run using the statistical function in Microsoft Excel™.

The streaking grades are provided as 0–4 visual grades using 5 expert panelists. The mean grade and standard deviations are computed. The significance of differences in visual grading is defined in analogous manner as described for the gloss-meter test.

| | A | B | C | D | E | F | G | H | I | J |
|---|---|---|---|---|---|---|---|---|---|---|
| Gloss | | | | | | | | | | |
| Mean treatment δ | 0.6 | (2.0) | 2.2 | 1.9 | (1.9) | 3.0 | 1.7 | (1.0) | 2.3 | 0.3 |
| Treatment δ Std. Dev. | 0.22 | 0.63 | 1.34 | 1.11 | 0.54 | 0.75 | 0.48 | 0.46 | 0.87 | 0.42 |
| Mean δ (PHMB-noPHMB) | Ref. | (2.6) | | Ref. | (3.8) | | Ref. | (2.7) | Ref. | (2.0) |
| δ (PHMB-noPHMB) Significant? | | Yes | | | Yes | | | Yes | | Yes |
| Mean δ (PHMB-Quat) | | Ref. | 4.2 | | Ref. | (4.9) | | | | |

-continued

| | | | | | | | | | | |
|---|---|---|---|---|---|---|---|---|---|---|
| δ (PHMB-Quat) Significant? | | | Yes | | | Yes | | | | |
| Visual | | | | | | | | | | |
| Mean grade | 0.0 | 0.0 | 1.6 | 0.4 | 0.4 | 1.6 | 0.8 | 0.3 | 1.2 | 0.5 |
| Treatment δ Std. Dev. | 0.06 | 0.09 | 0.41 | 0.25 | 0.28 | 0.3 | 0.33 | 0.19 | 0.4 | 0.25 |
| Mean δ (PHMB-noPHMB) | Ref. | 0.0 | | Ref. | | | Ref. | 0.5 | Ref. | 0.7 |
| δ (PHMB-noPHMB) Significant? | | No | | | | | | Yes | | Yes |
| Mean δ (PHMB-Quat) | | Ref. | 4.2 | | | | | | | |
| δ (PHMB-Quat) Significant? | | | Yes | | | | | | | |

| | K | L | M | N | O | P |
|---|---|---|---|---|---|---|
| Gloss | | | | | | |
| Mean treatment δ | 2.9 | (1.3) | (7.1) | (9.1) | (10.7) | (8.8) |
| Treatment δ Std. Dev. | 0.93 | 0.90 | 0.8 | 1.1 | 1.4 | 0.6 |
| Mean δ (PHMB-noPHMB) | Ref. | (4.2) | (7.7) | (11.0) | (13.0) | (11.7) |
| δ (PHMB-noPHMB) Significant? | Ref. | Yes | Yes vs. A | Yes vs. G | Yes vs. I | Yes vs. K |
| Mean δ (1% PHMB–.3% PHMB) | | | (5.1) vs. B | (8.1) vs. H | (11) vs. J | (7.5) vs. L |
| Visual | | | | | | |
| Mean grade | 0.9 | 0.4 | 0.1 | 0.4 | 0.6 | 0.4 |
| Treatment δ Std. Dev. | 0.28 | 0.15 | 0.16 | 0.23 | 0.46 | 0.23 |
| Mean δ (PHMB-noPHMB) | Ref. | (0.5) | 0.1 | (0.4) | (0.6) | (0.5) |
| δ (PHMB-noPHMB) Significant? | Ref. | Yes | No vs. A | Yes vs. G | Yes vs. I | Yes vs. K |
| Mean δ (1% PHMB–.3% PHMB) | | | 0.1 vs. B | 0.1 vs. H | 0.1 vs. J | 0.0 vs. L |

| | Q | R | S | T | U | V | W | X |
|---|---|---|---|---|---|---|---|---|
| Gloss | | | | | | | | |
| Mean treatment δ | 0.5 | 0.3 | 2.1 | 0.5 | 0.1 | 3.3 | 0.6 | (1.9) |
| Treatment δ Std. Dev. | 0.65 | 0.36 | 1.44 | 0.45 | 0.4 | 1.46 | 0.7 | 0.33 |
| Mean δ (PHMB-noPHMB) | Ref. | (0.2) | | Ref. | (0.5) | | Ref. | (2.5) |
| δ (PHMB-noPHMB) Significant? | Ref. | Yes | | Ref. | Yes | | Ref. | Yes |
| Mean δ (PHMB-Quat) | | Ref. | (1.8) | | Ref. | (3.4) | | |
| δ (PHMB-Quat) Significant? | | Ref. | Yes | | Ref. | Yes | | |
| Visual | | | | | | | | |
| Mean grade | 1.2 | 0.7 | 2.8 | 1.1 | 0.3 | 2.5 | 1.0 | 0.7 |
| Treatment δ Std. Dev. | 0.71 | 0.23 | 0.44 | 0.23 | 0.24 | 0.20 | 0.18 | 0.11 |
| Mean δ (PHMB-noPHMB) | Ref. | (0.6) | | Ref. | (0.8) | | Ref. | (0.3) |
| δ (PHMB-noPHMB) Significant? | Ref. | Yes | | Ref. | Yes | | Ref. | Yes |
| Mean δ (PHMB-Quat) | | Ref. | (2.1) | | Ref. | (2.3) | | |
| δ (PHMB-Quat) Significant? | | | Yes | | | Yes | | |

-continued

| | AA | AB | AC | AD | AE | AF | AG | AH |
|---|---|---|---|---|---|---|---|---|
| Gloss | | | | | | | | |
| Mean treatment δ | 1.2 | (3.2) | 5.4 | 0.3 | 4.9 | 0.3 | 0.7 | (9.2) |
| Treatment δ Std. Dev. | 0.58 | 0.9 | 1.23 | 0.20 | 1.4 | 0.62 | 0.3 | (3.2) |
| Mean δ (PHMB-noPHMB) | Ref. | (4.2) | Ref. | (5.0) | Ref. | (4.6) | Ref. | (9.9) |
| δ (PHMB-noPHMB) Significant? | Ref. | Yes | Ref. | Yes | Ref. | Yes | Ref. | Yes |
| Visual | | | | | | | | |
| Mean grade | 0.6 | 0.2 | 1.5 | 0.2 | 3.2 | 0.3 | 1.5 | 0.5 |
| Treatment δ Std. Dev. | 0.16 | 0.15 | 0.37 | 0.15 | 0.2 | 0.15 | 0.24 | 0.15 |
| Mean δ (PHMB-noPHMB) | Ref. | (0.4) | Ref. | (1.3) | Ref. | (2.9) | Ref. | (1.0) |
| δ (PHMB-noPHMB) Significant? | Ref. | Yes | Ref. | Yes | Ref. | Yes | Ref. | Yes |

Data Interpretation for Filming and Streaking:

Sponges:

Compositions A–F illustrate the filming and streaking benefits provided by compositions comprising polymeric biguanide as opposed to non-biguanide containing compositions and alternatives that substitute quaternary ammonium surfactant for the polymeric biguanide on an equal weight basis. In each case it is found that quaternary ammonium surfactants have a significant deleterious effect on filming streaking properties relative to compositions not comprising the quaternary ammonium surfactant, as measured analytically by gloss-meter readings or by trained expert graders (compare filming/streaking results obtained for treatments A and D versus those obtained for treatments C and F). Additionally, the polymeric biguanide-containing compositions (treatments A and D) significantly enhance the gloss of untreated tiles and provide a significant improvement versus compositions not comprising the polymeric biguanide.

Gloss enhancement of untreated tiles is also observed for treatment H and L, which incorporate low residue surfactant, and this enhancement can be traced directly to the inclusion of PHMB in the composition (compare gloss-meter and expert grades for treatments H vs G and L vs. K).

Treatment J, which does not comprise a low residue surfactant does not enhance the gloss of untreated tile. Note however, that increased amount of PHMB (1%) does result in gloss enhancement, i.e., compare treatments I, J and O.

Compositions M–P illustrate the impact of a higher PHMB level on tile gloss. These compositions, with 1% PHMB, provide increased gloss relative to corresponding treatments B, H, J and L, which comprise 0.3% PHMB and treatments A, G, I and K, which do not comprise PHMB. However, the increased gloss, as measured by the gloss-meter does not translate into any improvement in visual grade. The data suggest a point of diminishing returns in visual grades despite analytical gloss enhancement.

Compositions D, E and AA–AH illustrate the ability to use acids within the scope of this invention. Compositions comprising organic acid and inorganic acid all show gloss and visual grade benefits for polymeric biguanide (compare filming/streaking results for E vs. D, AB vs. AA, AD vs. AC, AF vs. AE, and AH vs. AG).

Absorbent Disposable Cleaning Pads:

In the case of the examples illustrating the use of a Swiffer Wet Jet™ (Q–X) pad in a floor cleaning application, the products with PHMB show an advantageous trend for gloss and visual grades versus corresponding products without PHMB. Thus, treatments R and U (with PHMB) have higher gloss retention means (mean δ) and visual grade means relative to treatments Q and T (without PHMB). Finally, the mean gloss and visual grades for products R and U with PHMB are significantly better than for corresponding products that incorporate quaternary ammonium antimicrobial agents (treatments S and V) instead of PHMB. Products W and X also show the benefits of PHMB, in the absence of an acidifying agent. Thus treatment X show significant gloss and visual grade advantages versus treatment W.

What is claimed is:

1. A composition for cleaning a hard surface comprising: at least one of the following:

a low-residue surfactant selected from the group consisting of sulfobetaines, ampho glycinates, ampho propionates, betaines, poly alkyl glycosides, sucrose esters and mixtures thereof, and an aliphatic alkyl ethoxylate surfactant;

a polymeric biguanide;

an aliphatic alcohol solvent; and organic acidifying agent is selected from the group consisting of tartaric acid, lactic acid, citric acid and mixtures thereof.

2. The composition of claim 1 wherein said low residue surfactant is a C8–C16 alkyl poly glycoside.

3. The composition of claim 2 wherein said composition has a pH of from about 5 to about 7.

4. The composition of claim 1 wherein said organic acidifying agent is citric acid.

5. The composition of claim 1 wherein said low-residue surfactant is selected from the group consisting of sulfobetaines, poly alkyl glycosides and mixtures thereof.

6. The composition of claim 1 wherein said aliphatic alkyl ethoxylate surfactant comprises from about 8 to about 18 carbon atoms in the hydrophobic chain length, and an average of about 1 to about 15 ethylene oxide moieties per surfactant molecule.

7. The composition of claim 1 wherein said polymeric biguanide is selected from the group consisting of oligo-hexamethylene biguanide, poly-hexamethylene biguanide, salt thereof and a mixture thereof.

8. The composition of claim 1, wherein said polymeric biguanide is poly (hexamethylene biguanide) hydrochloride.

9. The composition of claim 1 wherein said composition comprises from about 0.01% to about 30% by weight of said acidifying agent; and wherein the level of said low-residue surfactant and/or said aliphatic alkyl ethoxylate surfactant is from about 0.01% to about 15% by weight; the level of biguanide is from about 0.01% to about 20% by weight; and the pH of the aqueous composition is from about 0.5 to 7.

10. The composition of claim 9 wherein the level of said organic acidifying agent is from about 0.01% to about 3.0% by weight; the level of said low-residue surfactant and/or said aliphatic alkyl ethoxylate surfactant is from about 0.01% to about 1.5% by weight; the level of said polymeric biguanide is from about 0.01% to about 2.0% by weight; and the pH of the aqueous composition is from about 0.5 to 7.

11. The composition of claim 10 wherein the level of said organic acidifying agent is from about 0.05% to about 2.0% by weight; the level of said low-residue surfactant and/or said aliphatic alkyl ethoxylate surfactant is from about 0.01% to about 1.0% by weight; the level of said polymeric biguanide is from about 0.01% to about 1.0% by weight; and the pH of the aqueous composition is from about 1.0 to about 6.0.

12. The composition of claim 11 wherein the level of said organic acidifying agent is from about 0.1% to about 1.0% by weight; the level of said low-residue surfactant and/or said aliphatic alkyl ethoxylate surfactant is from about 0.03% to about 0.75% by weight; the level of said polymeric biguanide is from about 0.02% to about 0.75% by weight; and the pH of the aqueous composition is from about 2.0 to about 5.5.

13. The composition of claim 12 wherein the total level of solids is about 3% or less by weight of the aqueous composition.

14. The composition of claim 1 wherein said aliphatic alcohol is at a level from about 0.5% to about 25% by weight of a solvent.

15. The composition of claim 14 wherein said aliphatic alcohol solvent is at least one of methanol, ethanol, propanol, and isopropanol.

16. The composition of claim 15 further comprising a glycol ether solvent.

17. A method of cleaning hard surfaces comprising the step of contacting said surface with a composition according to claim 1.

18. The method of cleaning hard surfaces according to claim 17 wherein said method additionally comprises the step of wiping said surface during and/or after the step of contacting said surface with said aqueous composition.

19. The method of cleaning hard surfaces according to claim 18 wherein said step of wiping said surface is preformed by contacting said surface with a cleaning tool selected from the group consisting of sponges, cloths, cellulose strings, cellulose strips, paper, paper towels, premoistened wipe laminates and absorbent disposable cleaning pads.

20. The method of cleaning according to claim 19 wherein said aqueous composition is applied onto said cleaning tool prior to and/or during the wiping of said surface.

21. The method of cleaning according to claim 19 wherein said aqueous composition is delivered on said surface prior to and/or during the wiping of said surface.

22. A composition for treating a hard surface comprising:

at least one of the following: a low residue surfactant and an aliphatic alkyl ethoxylate surfactant;

an organic acidifying agent;

an aliphatic alcohol solvent;

a polymeric biguanide; and wherein said organic acidifying agent is selected from the group consisting of tartaric acid, lactic acid, citric acid and mixtures thereof.

23. The composition of claim 22 wherein the pH of said composition is from about 5 to about 7, and said low residue surfactant is a C8–C16 alkyl poly glycoside.

24. The composition of claim 22 wherein said low-residue surfactant is selected from the group consisting of zwitterionic surfactants, amphoteric surfactants, non-ionic surfactants comprising at least one sugar moiety and mixtures thereof.

25. The composition of claim 22 wherein said aliphatic alkyl ethoxylate surfactant comprises from about 8 to about 18 carbon atoms in the hydrophobic chain length, and an average of about 1 to about 15 ethylene oxide moieties per surfactant molecule.

26. The composition of claim 22 wherein said polymeric biguanide is selected from the group consisting of oligo-hexamethylene biguanide, poly-hexamethylene biguanide, salt thereof and a mixture thereof.

27. The composition of claim 22 wherein said polymeric biguanide is poly (hexamethylene biguanide) hydrochloride.

28. The composition of claim 22 wherein said composition comprises from about 0.01% to about 30% by weight of said acidifying agent; and wherein the level of said low-residue surfactant and/or an alkyl ethoxylate surfactant is from about 0.01% to about 15% by weight; the level of biguanide is from about 0.01% to about 20% by weight; and the pH of the aqueous composition is from about 0.5 to about 7.

29. The composition of claim 28 wherein the level of said organic acidifying agent is from about 0.01% to about 3.0% by weight; the level of said low-residue surfactant and/or an alkyl ethoxylate surfactant is from about 0.01% to about 1.5% by weight; the level of said polymeric biguanide is from about 0.01% to about 2.0% by weight; and the pH of the aqueous composition is from about 0.5 to about 7.

30. The composition of claim 29 wherein the level of said organic acidifying agent is from about 0.05% to about 2.0% by weight; the level of said low-residue surfactant and/or an alkyl ethoxylate surfactant is from about 0.01% to about 1.0% by weight; the level of said polymeric biguanide is from about 0.01% to about 1.0% by weight; and the pH of the aqueous composition is from about 1.0 to about 6.0.

31. The composition of claim 30 wherein level of said organic acidifying agent is from about 0.1% to about 1.0% by weight; the level of said low-residue surfactant and/or an alkyl ethoxylate surfactant is from about 0.03% to about 0.75% by weight; the level of said polymeric biguanide is from about 0.02% to about 0.75% by weight; and the pH of the aqueous composition is from about 2.0 to about 5.5.

32. The composition of claim 31 wherein the total level of solids is 3% or less by weight of the aqueous composition.

33. The composition of claim 22 wherein the level of said aliphatic alcohol solvent from about 0.5% to about 25% by weight of a solvent.

34. A method of cleaning hard surfaces comprising the step of contacting said surface with an aqueous composition according to claim 22.

35. The method of cleaning hard surfaces according to claim 34 wherein said method additionally comprises the step of wiping said surface during and/or after the step of contacting said surface with said aqueous composition.

36. The method of cleaning hard surfaces according to claim 35 wherein said step of wiping said surface is performed by contacting said surface with a cleaning tool selected from the group consisting of sponges, cloths, cellulose strings, cellulose strips, paper, paper towels, premoistened wipe laminates and absorbent disposable cleaning pads.

37. A disposable premoistened wipe for cleaning hard surfaces comprising:

a substrate impregnated with the cleaning composition of claim 1.

38. The disposable premoistened wipe of claim 37 wherein said substrate comprises a cellulosic material.

39. A cleaning system for cleaning hard surfaces comprising:

a disposable dry absorbent substrate; and a container filled wit the cleaning composition of claim 1.

* * * * *